United States Patent [19]

Peterson

[11] Patent Number: 4,555,908

[45] Date of Patent: Dec. 3, 1985

[54] ADD-ON BRINE FLOW SYSTEM FOR REFRIGERATED TANK OF FISHING VESSEL

[76] Inventor: Earl A. Peterson, 4111 Chestnut Ave., Long Beach, Calif. 90807

[21] Appl. No.: 607,511

[22] Filed: May 7, 1984

[51] Int. Cl.[4] ..... F25D 17/02

[52] U.S. Cl. ..... 62/64; 62/98; 62/376

[58] Field of Search ..... 62/98, 64, 376, 418, 62/421, 444; 165/108, 132

[56] References Cited

U.S. PATENT DOCUMENTS

| | | | |
|---|---|---|---|
| 1,670,187 | 5/1928 | Browne | 62/418 |
| 2,766,598 | 10/1956 | Amoit | 62/170 |
| 2,909,040 | 10/1959 | Newell | 62/59 |
| 2,982,109 | 5/1961 | Puretic | 62/64 |
| 3,049,890 | 8/1962 | Ruppel | 62/64 |
| 3,802,214 | 4/1974 | Prieto | 62/64 |

*Primary Examiner*—William E. Wayner

*Attorney, Agent, or Firm*—Spensley Horn Jubas & Lubitz

[57] ABSTRACT

Disclosed is an add-on system for improving the efficiency of a brine flow refrigerated fish tank. This add-on system includes an upper brine distribution manifold which provides a uniform brine flow over the top of the fish in the fish tank, an interior brine distribution manifold which provides brine flow into the interior of the fish tank when filled with fish, a plurality of perforated plates mounted to the bulkheads forming the sides of the fish tank which provide brine flow courses along the bulkheads, and a suction manifold which provides controlled brine flow from the brine flow courses to the brine circulation pump located outside the fish tank.

19 Claims, 11 Drawing Figures

ADD-ON BRINE FLOW SYSTEM FOR REFRIGERATED TANK OF FISHING VESSEL

FIELD OF THE INVENTION

This invention relates to add on systems for refrigerated tanks used in fishing vessels, and in particular, refrigerated tanks using circulating brine as part of the refrigeration system.

BACKGROUND OF THE INVENTION

Modern fishing fleets commonly undertake cruises over distances of thousands of miles and durations of several months. Such long duration voyages are made possible by refrigerated fish tanks which have the capability of freezing a large catch of fish to minimize spoilage of the fish.

The refrigerated fish tank commonly used in large fishing vessels has remained virtually unchanged over the last thirty years. For example, the fish tanks on board an average (e.g.,1200 ton), modern tuna fishing vessel, would have a capacity of 60 tons of tuna each. Each tank has a generally cubical configuration with a hatch opening at the top for loading the fish. The overhead, deck, fore, aft, inboard, and outboard bulkheads are lined with refrigeration pipe coils. The fish tank employs a pumping system comprising a circulation pump located behind the inboard bulkhead, a suction pipe located near the bottom of the fish tank and covered by a perforated metal guard, and a discharge pipe located in the hatch coaming at the top of the fish tank.

When a fishing vessel has reached a suitable fishing location, sea water is first pumped into the fish tank. The sea water is circulated by the pump and cooled by contact with the refrigeration coils. Catches of fish are then added to the cold sea water in the tank until the tank is full. Using sea water as a cooling medium in this manner the fish may be cooled to approximately 30° fahrenheit. After the fish have been cooled to approximately 30° fahrenheit, the fish tank is drained of sea water and the sea water is replaced by a high salt content brine. The brine is circulated through the fish by the pumping system, and the temperature of the fish is reduced to a point where the fish are completely frozen, i.e., corresponding to a temperature of 10° fahrenheit or less.

The use of a brine flow refrigeration system in fishing vessel fish tanks, along with the fish spoilage inhibiting effects of such a system, have been known since at least 1955. For example, the use of such a system is described in a report by Lionel Farber entitled "Refrigeration of Tuna and Sardines by Sodium Chloride Brines", published in Food Technology, Volume IX, 1955, No. 3, pages 141–147. In such a system, it is important to minimize the time taken for the fish to freeze from 30° fahrenheit to less than 20° fahrenheit. Above 20° fahrenheit, salt will penetrate the flesh of the fish from the strong salt brine solution, reducing the quality of the fish for processing purposes. In addition, until the fish are cooled below 20° fahrenheit, bacterial and enzymic action are not completely halted.This also reduces fish quality and may cause fish spoilage for some percentage of the catch. Accordingly, the optimum brine flow refrigerated fish tank would cause the fish catch to uniformly be lowered below 20° fahrenheit as rapidly as possible.

The brine refrigerated fish tanks currently in use are extremely inefficient in providing rapid and uniform cooling of the fish mass in the tank for several reasons. One source of inefficiency is the uncertain and nonuniform distribution and direction of the brine flow through the fish in the fish tank. The discharge pipe of the pumping system distributes the brine at a single point at the top of the fish mass located in the fish tank. The brine therefore flows approximately linearly to the suction pipe with the brine having minimal circulation around the refrigeration pipes and corners opposite the suction inlet.

Another source of inefficiency of the standard brine flow system is the interference of the fish themselves with the effectiveness of the refrigeration pipes. The fish will tend to lie horizontally in the fish tank and tightly pack around the horizontal refrigeration pipes, thereby covering a substantial percentage of the pipe surface. This packing of the fish around the refrigeration pipes will reduce the brine flow around the pipes and provide an insulating effect thereby reducing the cooling effect of the pipes and the efficiency of the refrigation system.

Yet another inefficiency in the standard brine flow system in existing fish tanks is the nearly total lack of brine flow throughout a substantial portion of the interior of the fish mass. Tuna, and several other types of fish commonly caught by fishing vessels using brine refrigerated fish tanks, have a shape which enables them to pack together very tightly when placed in the fish tank. With the lack of a positive brine flow path through the interior of the fish mass, the packing of the fish can almost totally prevent brine circulation through large portions of the interior of the fish mass.

The effect of the above-noted inadequacies in the existing brine flow system utilized in fishing vessels is that the freezing of the fish in the fish tank will occur very nonuniformly. More specifically, fish packed around the refrigeration pipes will freeze very rapidly below the critical 20° fahrenheit temperature and will suffer only acceptable salt penetration. Similarly, fish located near the actual path taken by the brine through the fish mass will also cool quite rapidly below the critical 20° fahrenheit temperature. On the other hand, fish located away from the actual brine flow path or packed tightly in the interior of the fish mass, will take substantially longer to cool below 20° fahrenheit and will suffer correspondingly greater salt penetration and bacterial and/or enzymic damage.

Accordingly, it is an objective of the present invention to increase the freezing capability of an existing brine tank refrigeration system thereby reducing the freezing period. It is a further object of the present invention to provide positive brine flow throughout substantially all of the fish mass in a brine refrigerated fish tank.

It is a further object of the present invention to provide positive brine flow around a substantial portion of the refrigeration coils in a brine refrigerated fish tank.

It is a further object of the present invention to provide a system suitable for accomplishing the above objectives by relatively easy and inexpensive modification of existing fishing vessel fish tanks employing brine refrigeration systems.

SUMMARY OF THE INVENTION

The above and other objects are achieved by providing an add-on brine flow system for use with existing fish tanks employing brine refrigeration.

The add-on brine flow system may include a brine distribution manifold which is attached to the brine discharge pipe of the fish tank. The distribution manifold has one segment encircling the fish tank hatch and providing brine distribution over the top of the fish mass and a second segment extending through the center of the fish mass and providing positive brine flow into the interior of the fish mass. The details of the configuration of the distribution manifold may take several different embodiments. In an economical but effective embodiment, the upper distribution manifold may take the form of plates attached to the overhead refrigeration coils to provide brine flow to the side refrigeration coils and over the top of the fish mass.

Vertical brine flow courses are provided along the side bulkheads of the fish tank to allow brine circulation over the refrigeration pipes. These brine flow courses may be provided by attaching elongated, rectangular perforated metal plates to the existing refrigeration pipes along the tank walls to prevent fish packing around the refrigeration pipes and to allow brine flow over the pipes. A flow course along the bottom of the fish tank may also be provided by attaching elongated rectangular metal plates to the deck refrigeration pipes.

A suction manifold is provided which may be attached to the suction pipe of a brine refrigerated fish tank. The suction manifold has discrete inputs below the vertical brine flow courses providing positive brine flow along the flow courses. In an alternate embodiment, the suction manifold may extend upward through the interior of the fish tank providing additional positive brine flow through the interior of the fish mass.

BRIEF DESCRIPTION OF THE DRAWINGS

In the drawings, wherein like numbers refer to corresponding components in the several figures.

DESCRIPTION OF THE PREFERRED EMBODIMENTS

The following description is of the best presently contemplated modes in carrying out the invention. This description is made for the purpose of illustrating the general principles of the invention and is not to be taken in a limiting sense. The scope of the invention is best determined by the appended claims.

Figure 1:
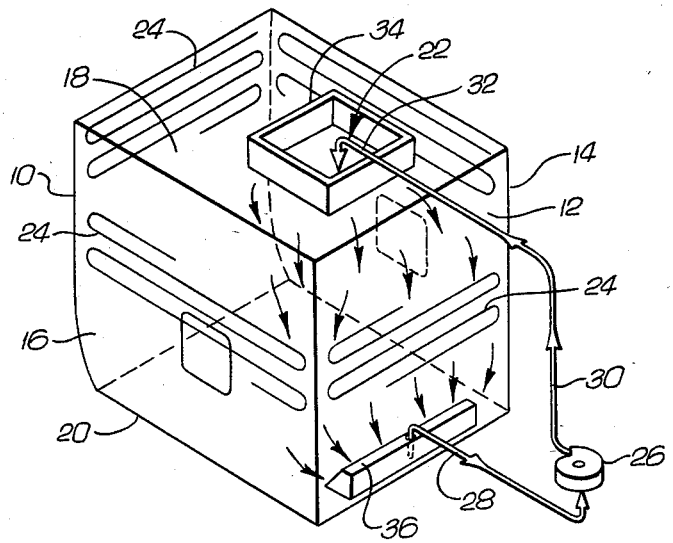
FIG. 1 PRIOR ART
FIG. 1 is a perspective view of a standard prior art fish tank employing brine flow refrigeration.

Referring to FIG. 1, the basic configuration of a brine flow refrigerated fish tank currently employed in fishing vessels is shown. The tank has generally a cubical shape, with, however, curved outboard bulkhead 10 reflecting the general shape of the shipping vessel. The tank also has an inboard bulkhead 12, fore and aft bulkheads 14 and 16, an overhead bulkhead 18 and a deck bulkhead 20. The tank has a hatch opening 22 positioned in the center of the overhead bulkhead 18 for loading fish into the tank. The capacity of such a fish tank forming part of a modern deep sea fishing vessel would be approximately 60 tons of fish (representing a capacity of approximately 3330 cubic feet).

The refrigeration system of a standard brine refrigerated fish tank employs refrigeration pipes 24 (partly shown in FIG. 1), along all bulkheads. As can be seen from FIG. 1, the refrigeration pipes 24 are oriented horizontally and are evenly spaced, having approximately a six inch spacing between centers of adjacent pipes.

The brine circulation system employed as part of the refrigeration system utilizes a circulation pump 26 located behind the inboard bulkhead 12 of the fish tank. Once the fish tank is filled with brine, (or sea water, depending on the stage of the refrigeration operation) the brine is drawn from the bottom of the fish tank by the suction pipe 28, pumped upward by means of the circulation pump 26 through the brine flow pipe 30, and distributed at the top of the fish tank by the brine discharge pipe 32. Typically, the brine discharge pipe will be located in the hatch coaming 34. The suction pipe 28 will normally have a metal grid 36 over its end to prevent fish from being sucked into the pipe.

The arrows in FIG. 1 indicate expected brine flow through the fish tank when filled with fish, based on the configuration of the tank and the brine discharge pipe 32 and suction inlet pipe 28. As can be seen the expected brine flow is significant only through a relatively small portion of the fish mass. The detailed nature of the flow will, of course, depend on the particular manner in which the fish pack as they are loaded into the tank and moved around by various forces.

Figure 2:
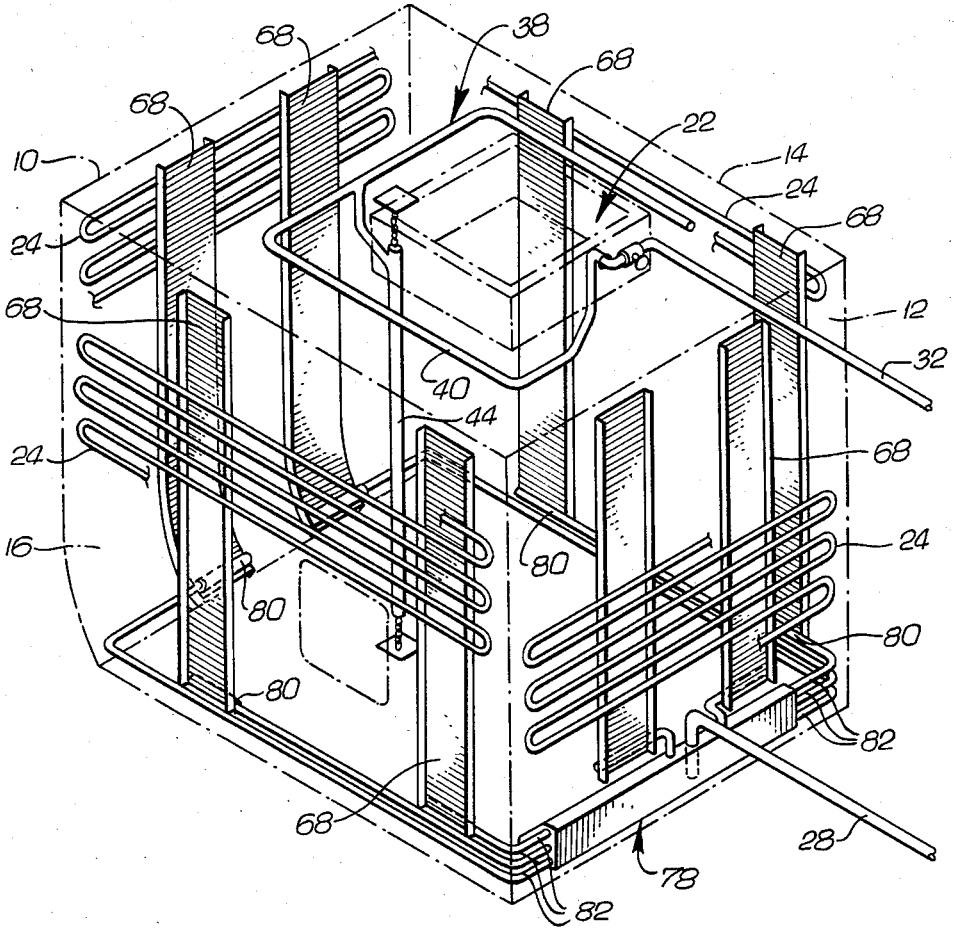
FIG. 2 is a perspective view of the prior art fish tank of FIG. 1 incorporating a preferred embodiment of the add-on system of the present invention.

In FIG. 2, the preferred embodiment of the addon brine flow system of the present invention is shown. The system includes an upper brine distribution manifold 38, interior brine distribution manifold 44, vertical bulkhead flow courses plates 68, flow course suction manifolds 80, and suction manifold 78.

Upper brine distribution manifold 38 is connected to the brine discharge pipe 32 of the brine refrigerated fish tank. The upper brine distribution manifold 38 consists of a pipe 40 of suitable material, preferably a flexible material such as plastic, with uniformly spaced holes 42 positioned along its lower surface to provide a brine flow of desired rate. The diameter of the pipe 40 is chosen to provide desired pressure for the brine flow. For a standard 60 ton capacity brine refrigerated fish tank, a pipe diameter of approximately 4 inches would be suitable.

Figure 3:
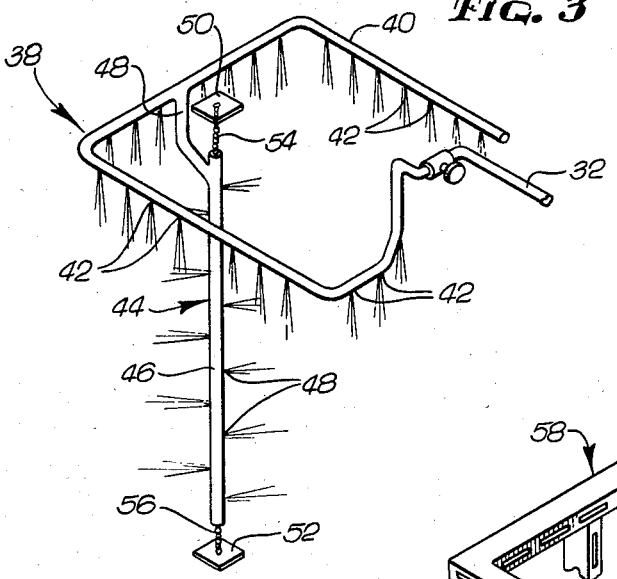
FIG. 3 is a perspective view of the upper and interior brine distribution manifold.

FIG. 3 shows the configuration of the upper brine distribution manifold in greater detail. The upper distribution manifold 38 has an approximately rectangular configuration when viewed from below with the pipe 40 positioned between the sides of the hatch 22 and the bulkheads 10, 12, 14, 16. The configuration shown provides a uniform brine flow over the top of the fish mass in the tank. The size of the holes 42 in the pipe 40, coupled with the pressure of the brine introduced into the distribution manifold 38, can be chosen to give a spraying effect to the brine as it leaves the manifold 38 thereby increasing the uniformity of brine distribution.

In an alternate embodiment, the upper brine distribution manifold may take the form of one or more plates attached to the overhead refrigeration pipes. These plates will have slightly concave cross-sectional shapes and act as troughs to carry brine from the hatch coaming, over the top of the fish mass to the vertical flow courses. The depth of the troughs can be selected to provide for the desired amount of brine flow over the sides of the plates onto the top of the fish mass. This alternate embodiment thus provides an economical yet effective means for distributing the brine.

FIGS. 2 and 3 also show the interior brine distribution manifold 44 connected to the upper distribution manifold 38. FIGS. 2 and 3 show such an interior distribution manifold 44. In alternate embodiments, more than one, interior distribution manifolds may be used.

Referring to FIG. 3 a preferred embodiment of the interior distribution manifold 44 consists of a flexible pipe 46 of an appropriate material, e.g. plastic. The diameter of the pipe 46 is chosen to provide brine flow under an appropriate pressure, a preferable diameter being approximately two inches in a system for use with a standard 60 ton fish tank. The flexible pipe 46 has a plurality small holes 48 positioned evenly throughout its length and around its circumference. The pipe 46 is connected to the upper distribution manifold 38 by a short, flexible connecting pipe 48. The connecting pipe 48 may also have holes for providing brine flow. The pipe 46 is held in place by suitable anchoring means. A preferred form of anchoring means, providing relatively easy installation in a standard fish tank, consists of first and second anchor plates 50 and 52, bolted or otherwise suitably mounted to the overhead bulkhead 18 and deck bulkhead 20 respectively. The first anchor plate 50 is attached to the top of the pipe 46 by a length of chain 54 or other appropriate flexible connecting means. The second anchor plate 52 is similarly connected to the bottom of the pipe 46 by a second length of chain 56. Since the pipe 46 is flexible, the first anchor plate 50 need not be positioned directly over the second anchor plate 52, and the interior distribution manifold 38 may extend diagonally throughout a large portion of the interior of the fish tank.

Figure 4:
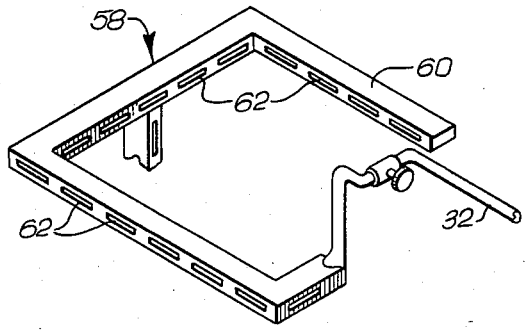
FIG. 4 is a perspective view of the upper and interior brine distribution manifold of an alternate embodiment.

FIG. 4 shows an alternate embodiment of the upper distribution manifold 58. This embodiment of the upper distribution manifold 58 consists of a rectangular conduit 60 with slots 62 evenly spaced along its sides to allow brine flow at a desired rate.

An alternate embodiment of the interior distribution manifold 46 (not shown) employs a rigid pipe extending vertically between the overhead bulkhead 18 and the deck surface 20. For a standard size, 60 ton capacity fish tank, the pipe would have approximately an eight inch diameter. A plurality of slot shaped openings are provided along the length of the pipe for controlled brine flow into the interior of the fish mass. A grid shaped guard surrounds the pipe to prevent tightly packed fish from blocking the slots.

Figure 5:
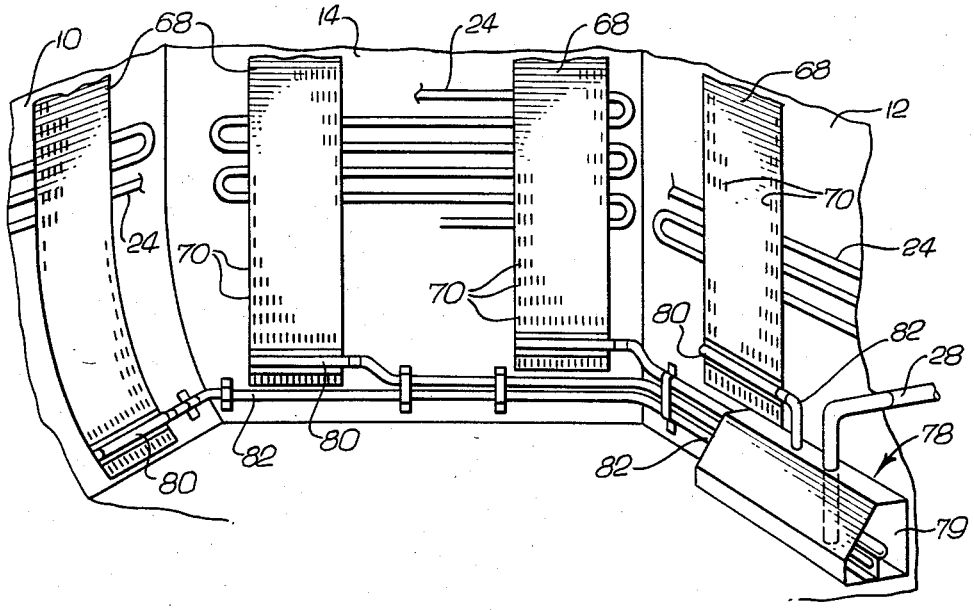
FIG. 5 is a perspective view of the interior of the fish tank showing the brine flow course plates and flow course suction manifolds.

Referring to FIGS. 2 and 5, the bulkhead flow course system is shown. The bulkhead flow course is provided in an existing brine refrigerated fish tank by affixing elongated flow course plates 68 to the refrigeration pipes 24 on the outboard, inboard, fore, and aft bulkheads 10, 12, 14, 16. The flow course plates 68, are preferably composed of metal and are rectangular in shape having length allowing the plates 68 to extend vertically for nearly the entire height of the fish tank. As shown in FIGS. 2 and 5, in a preferred embodiment and for a standard 60 ton capacity fish tank, two flow course plates 68 would be mounted on each of the side bulkheads, i.e., outboard, inboard fore, and aft bulkheads 10, 12, 14, 16. Additional plates 68 could be mounted on the bulkheads if desired and if the particular geometry of the fish tank so permitted.

The addition of the flow course plates 68 to the side bulkheads creates bulkhead brine flow courses by preventing fish from packing around the refrigeration pipes 24. This allows brine to flow freely over the refrigeration pipes 24 in a vertical direction behind the elongated flow course plates 68. Since the sole source of refrigeration in the fish tank is the refrigeration pipes 24, providing for unobstructed brine flow over the pipes serves to greatly increase the efficiency of the overall refrigeration system. Perforations 70 in the plates 68 are provided as inlets into the bulkhead flow course for brine from the interior of the fish mass. This provides additional brine circulation through the interior of the fish mass. In particular, when the perforated flow course plates 68 are combined with the interior brine distribution manifold 44 greatly increased brine flow through the interior of the fish mass is provided.

Figure 6:
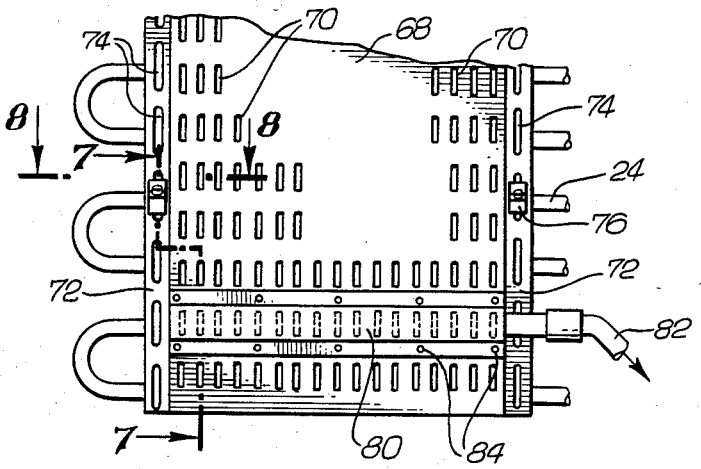
FIG. 6 is a detailed view of the brine flow course plates of FIG. 5.
Figure 7:
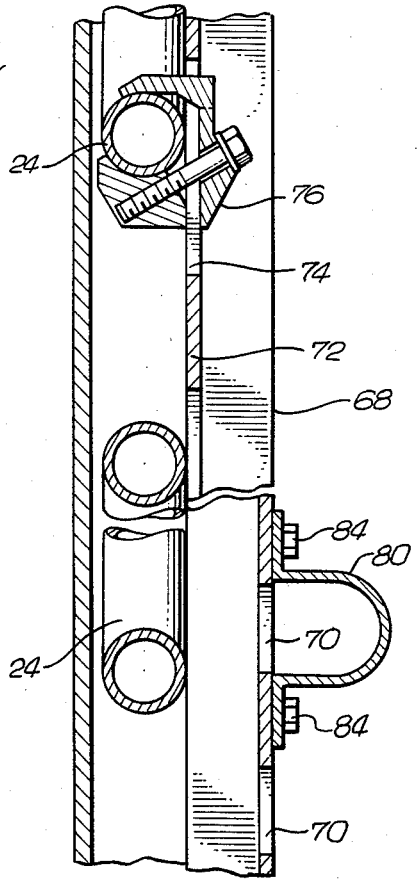
FIG. 7 is a side view of the mounting system used for securing the flow course plate of FIG. 6.
Figure 8:
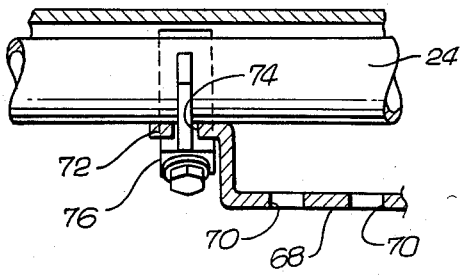
FIG. 8 is an end view of the mounting system.

FIG. 6 shows a flow course plate 68 in more detail. The perforations 70 are preferably rectangular or oval shaped slots evenly distributed horizontally and vertically along the plates 68. These perforations 70 allow brine to flow into the flow course but yet prevent the fish from being pushed through to block the refrigeration pipes 24. The plate 68 has slotted flanges 72, along each elongated side. These flanges 72 are inset from the outer plane of the plate 68 to allow a suitable space for brine flow between the refrigeration pipes 24 and the plate 68. The flanges 72 are provided with slots 74 to allow clamps 76 to extend through the slots and fasten to the refrigeration pipes 24. A large number of slots 74 are provided to allow for various spacings of refrigeration pipes 24 and to allow sufficient clamps 76 to be utilized to securely mount the flow course plate 68 in place.

Flow courses may also be provided along the deck bulkhead 20 of the fish tank. Such flow courses would be formed similarly to the vertical bulkhead flow courses in that flow course plates would be mounted to the refrigeration pipes on the deck bulkhead 20. These horizontal flow course plates would be of similar design to the vertical flow course plates, however not having perforations. The perforations are omitted in the deck bulkhead flow course plates to prevent damage to the fish lying on the plates due to the weight of the fish mass above.

Referring to FIGS. 2, 5 and 6, a suction manifold 78 and flow course suction manifolds 80 are shown. The suction manifold 78 surrounds the suction pipe 28 and provides controlled and uniform brine flow into the suction pipe 28 from several locations around the bottom of the fish tank. In the preferred embodiment, the suction manifold 78 is an elongated enclosure 79 with the suction pipe 28 located in the center, and near the bottom, of the interior of the enclosure 79. The suction manifold 78 has calculated size pipes 82 extending from its sides to the flow course suction manifolds 80 attached to the bottoms of the vertical flow course plates 68. The diameter of the pipes 82 is chosen to allow uniform and positive brine flow from each of the vertical flow courses into the suction manifold 78 and suction pipe 28. The flow course suction manifold 80 comprises an elongated opening at the end of the pipe 82 which is of length corresponding to the width of the flow course plate 68 and height corresponding to the length of the perforations 70. The flow course suction manifold 80 may be mounted to the flow course plate 68 by any suitable means, preferably being a plurality of metal screws 84 or bolts. The flow course suction manifold 80 will preferably be mounted to the exterior face of the flow course plate 68 to provide brine flow behind the plate 68.

Figure 10:
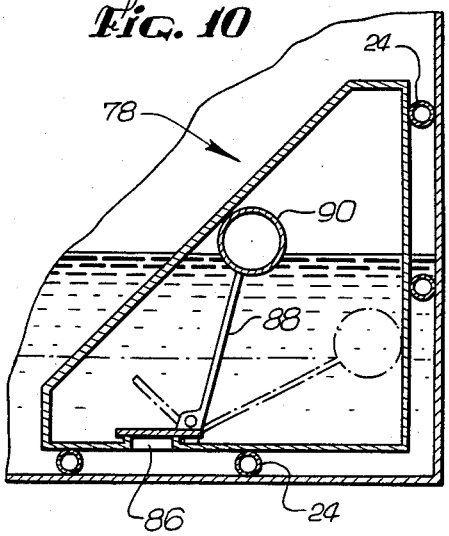
FIG. 10 is a section view of the suction manifold showing the float pump down valve arrangement.

Referring to FIG. 10, the suction manifold 78 is shown. The suction manifold 78 has calculated size holes (not shown) in the bottom of the enclosure to provide for brine flow along the bottom of the fish tank into the suction manifold 78. In addition, larger holes 86 covered with float valves 88, are provided in the bottom of the enclosure. The holes 86 in conjunction with the float valves 88 allow pumping the fish tank almost completely dry by use of the suction pipe 28 and circulation pump 26, when the fish tank is to be unloaded. This capability is advantageous since brine is relatively expensive due to its high salt content and draining the fish tank by means of drains located in the deck bulkhead 20 of the fish tank would waste substantial quanitities of the valuable brine. More specifically, as the brine level in the fish tank drops below the flow course suction manifolds 80, the effectiveness of the circulation pump 26 would be greatly reduced since brine could only be drawn from the calculated size holes in the bottom of the suction manifold 78. The float valves 88 compensate for this effect by remaining closed as long as the suction manifold is full of brine, however, when the brine level drops below the float 90 of the float valve 88, the valves open, providing additional brine flow into the bottom of the suction manifold 78 by virtue of the larger openings 86.

Figure 9:
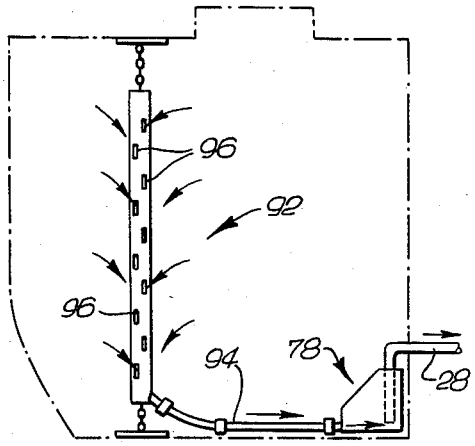
FIG. 9 is a side view of an alternate embodiment of the suction manifold.

FIG. 9 shows an interior suction manifold 92 connected to the suction manifold 78 by a connecting pipe 94. The shape, size and mounting system of the interior suction manifold 92 is very similar to the interior distribution manifold 38 shown in FIG. 4. The interior suction manifold, however, employs larger slotted holes 96 to insure positive brine flow into the interior suction manifold 92.

In an add-on system employing the suction manifold, no flow course suction manifolds are provided. This embodiment of the suction manifold is suitable for use with a deck bulkhead flow course system. A truncated version of the interior suction manifold 92, however, would be suitable for use with the upper distribution manifold employing plates or troughs attached to the upper refrigeration pipes, along with the vertical flow courses. Such a truncated version of the interior suction manifold 92 would only extend upward a short distance from the deck bulkhead and would have a corresponding long upper chain attached to the upper bulkhead.

The various embodiments of the individual elements of the add-on brine flow system of the present invention may be used singly or in combination to provide various brine flow courses through the fish tank when filled with fish. The selection of the particular add-on elements will depend on various factors including the size of the fish tank, type of fish caught, and cost of the system.

Figure 11:
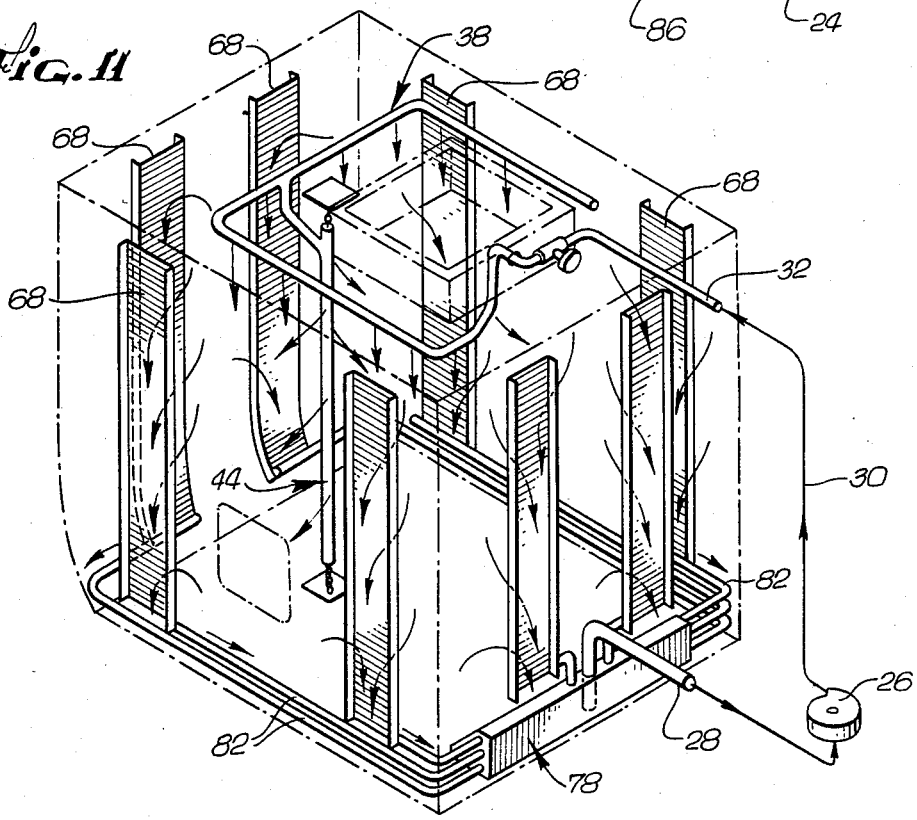
FIG. 11 shows expected brine flow in the fish tank of FIG. 2.

FIG. 11 shows an optimal configuration of add-on elements for increasing brine circulation. The system includes an upper brine distribution manifold 38, interior brine distribution manifold 44, vertical bulkhead flow courses plates 68, flow course suction manifolds 80, and suction manifold 78. FIG. 11 shows anticipated brine flow in the fish tank employing the add-on system of FIG. 2 when the tank is completely filled with fish. As will be seen, substantially uniform brine flow throughout the fish mass is provided as well as effective flow over a substantial area of the refrigeration pipes (not shown). The brine flow shown in FIG. 11 would provide a dramatic decrease in freezing time for the fish as well as almost completely uniform freezing time throughout the fish mass. The corresponding decrease in salt penetration and bacterial and enzymic degradation of the fish would result an in equally dramatic increase in the average quality of the fish when delivered to the processing plants.

It will be apparent to one skilled in the art that a wide variety of modifications of the disclosed add-on system may be made without departing from the spirit or scope of the present invention. In particular, variations are possible in the specific geometry and size of the elements of the add-on brine flow system of the present invention. Other alternate embodiments and modifications will also be apparent to those skilled in the art.

I claim:

1. A brine flow refrigeration system for use with a fishing vessel fish tank having fore, aft, inboard, outboard, overhead and deck bulkheads having refrigeration elements thereon, a brine circulation pump, a brine suction pipe at the bottom of the fish tank connected to the input of the brine circulation pump, and a brine discharge pipe located near the top of the fish tank connected to the output of the brine circulation pump; the improvement comprising:

an upper brine distribution manifold comprising an elongated, U-shaped, perforated pipe connected to the brine discharge pipe by a connecting pipe;

an interior distribution manifold comprising an elongated perforated pipe connected to the upper brine distribution manifold by a second connecting pipe, the upper and lower ends of the flexible perforated pipe being attached to the overhead and deck bulkheads, respectively;

a plurality of perforated flow course plates attached to selected ones of the plurality of refrigeration elements and extending vertically along the side bulkheads of the fish tank;

a suction manifold enclosing the brine suction pipe, having a plurality of pipes extending from its sides; and a plurality of flow course suction manifolds attached to each of said plurality of flow course plates, and connected to the suction manifold by said plurality of pipes.

2. A brine flow refrigeration system as described in claim 1, wherein each of the plurality of flow course plates has an elongated rectangular shape with a recessed flange running the length of each elongated side, the flanges having a plurality of elongated slots for receiving mounting clamps.

3. A brine flow refrigeration system as described in claim 1, wherein the suction manifold comprises an elongated enclosure having six sides, one side being beveled, the bottom side having at least one hole of a first size and at least one larger hole, said enclosure including a float valve movably covering said at least one larger hole.

4. A brine flow refrigeration system for use with a fishing vessel fish tank having fore, aft, inboard, outboard, overhead and deck bulkheads having refrigeration elements thereon, a brine circulation pump, a brine suction pipe at the bottom of the fish tank connected to the input of the brine circulation pump, and a brine discharge pipe located near the top of the fish tank connected to the output of the brine circulation pump; the improvement comprising:

a brine discharge manifold connected to the brine discharge pipe for distributing the brine substantially uniformily around the top of the fish tank;

a plurality of vertical flow course plates attached to selected ones of the plurality of refrigeration pipes on the fore, aft, interior and outboard bulkheads, each of said plurality of plates having a rectangular planar shape, elongated in the vertical direction, and a plurality of holes extending through the planar surface;

one or more deck flow course plates attached to the refrigeration pipes on the deck bulkhead, each of said one or more plates having an elongated rectangular planar shape;

a suction manifold attached to the lower portion of the inboard bulkhead and enclosing the brine suction pipe, said manifold comprising an elongated enclosure having a plurality of slot-like openings on the top, front and sides.

5. An add-on system for improving brine circulation in a brine flow refrigerated fish tank, having refrigeration pipes on the side bulkhead, in a fishing vessel comprising:

distribution means for uniformly distributing the brine;

vertical bulkhead flow course means for providing a pathway for brine to flow along the side bulkheads and over the refrigeration pipes of the fish tank in a top to bottom direction;

enclosure means for controlling brine flow out of the fish tank.

6. An add-on system as described in claim 5, wherein the brine distribution means includes an interior brine distribution manifold comprising, a flexible brine distribution pipe having a plurality of small holes, a flexible connecting pipe attached to the brine discharge pipe, and means for attaching the brine distribution pipe to one or more of the overhead bulkhead or deck bulkhead of the fish tank.

7. An add-on system as described in claim 6, wherein the flow course means comprises a plurality of elongated, rectangular flow course plates, each having a plurality of slotted holes and having flanges on each elongated side, and means for mounting the plates to the bulkheads of the fish tank, the flanges including a plurality of elongated slots for receiving said means for mounting.

8. An add-on system as described in claim 7, wherein each of the mounting means comprises a clamp having a first clamp element, a second clamp element and a bolt for drawing the first clamp element and second clamp element together, the first clamp element having a widened upper segment including a bolt receiving hole and having a width larger than said receiving slot, and a second segment having width narrower than that of said receiving slot and having an arcuate cross-sectional shape, and the second clamp element having a bolt receiving hole and a cross-sectional arcuate shape.

9. An add-on system as disclosed in claim 6, wherein the enclosure means includes a suction manifold enclosure, and a plurality of flow course suction manifolds attached to the bottom portion of each of the plurality of flow course plates and connected to the manifold enclosure by a plurality of elongated connecting pipes.

10. A method for improving brine circulation in a brine flow refrigerated fish tank having fore, aft, inboard, outboard, overhead and deck bulkheads having a plurality of refrigeration pipes thereon, including the steps of:

distributing the brine substantially uniformily over the top and through the interior of the fish tank;

drawing the brine across the refrigeration pipes of the fish tank along brine flow courses along one or more of the fish tank bulkheads;

drawing the brine into one or more suction manifolds from the interior of the fish tank and from along the bulkhead brine flow courses.

11. A method for improving brine circulation as described in claim 10 wherein the step of drawing brine along the bulkhead flow courses includes preventing fish from packing around refrigeration pipes attached to the bulkhead along said brine flow courses and providing a plurality of brine flow inlets to said brine flow course.

12. A method for improving brine circulation as described in claim 10 wherein the step of drawing the brine includes drawing the brine through a portion of the interior of the fish tank.

13. A method for brine circulation in a brine flow refrigerated fish tank having refrigeration means mounted to the side bulkhead including the steps of; drawing brine from near the bottom of the fish tank, pumping the brine to the top of the fish tank along a path outside the fish tank, and discharging the brine into the fish tank near the top of the fish tank; the improvement comprising providing brine flow along a plurality of brine flow courses along the side bulkheads and adjacent the refrigeration means of the fish tank.

14. A method as described in claim 13 further including the step of providing controlled flow brine distribution through the interior of the fish tank.

15. A method as described in claim 13 further including the step of drawing brine from the interior of the fish tank into an interior brine suction flow course.

16. A method as described in claim 13 further including the step of providing a brine flow course along the deck bulkhead of the fish tank.

17. A method for brine circulation in a brine flow refrigerated fish tank including the steps of; drawing brine from near the bottom of the fish tank, pumping the brine to the top of the fish tank along a path outside the fish tank, and discharging the brine into the fish tank near the top of the fish tank; the improvement comprising providing controlled flow brine suction from a vertically extending region in the interior of the fish tank.

18. A brine flow refrigeration system for use with a fishing vessel fish tank having fore, aft, inboard, outboard, overhead and deck bulkheads having refrigeration elements thereon, a brine circulation pump, a brine suction pipe at the bottom of the fish tank connected to the input of the brine circulation pump, and a brine discharge pipe located near the top of the fish tank connected to the output of the brine circulation pump; the improvement comprising:

an upper brine distribution manifold comprising one or more elongated, trough-shaped plates attached to the overhead bulkhead refrigeration elements each having one end adjacent said brine discharge pipe;

a plurality of perforated flow course plates attached to selected ones of the plurality of refrigeration elements and extending vertically along the side bulkheads of the fish tank;

a suction manifold enclosing the brine suction pipe, having a plurality of pipes extending from its sides; and an interior suction manifold comprising a short slotted pipe connected to the suction manifold by a connecting pipe, the upper and lower ends of the flexible perforated pipe being attached to the overhead and deck bulkheads, respectively.

19. A brine flow refrigeration system as described in claim 18, wherein each of the plurality of flow course plates has an elongated rectangular shape with a recessed flange running the length of each elongated side, the flanges having a plurality of elongated slots for receiving mounting clamps.

* * * * *